US006607656B2

(12) United States Patent
Christini

(10) Patent No.: US 6,607,656 B2
(45) Date of Patent: Aug. 19, 2003

(54) USE OF RECUPERATIVE HEATING FOR START-UP OF ELECTROLYTIC CELLS WITH INERT ANODES

(75) Inventor: Roy A. Christini, Apollo, PA (US)

(73) Assignee: Alcoa Inc., Pittsburgh, PA (US)

( * ) Notice: Subject to any disclaimer, the term of this patent is extended or adjusted under 35 U.S.C. 154(b) by 214 days.

(21) Appl. No.: 09/888,769

(22) Filed: Jun. 25, 2001

(65) Prior Publication Data

US 2002/0195350 A1 Dec. 26, 2002

(51) Int. Cl.[7] ..... C25C 3/06; C25C 3/22; C25C 3/20

(52) U.S. Cl. ..... 205/354; 205/372; 205/390; 205/391; 205/396

(58) Field of Search ..... 204/241; 205/354, 205/391, 396, 390

(56) References Cited

U.S. PATENT DOCUMENTS

| | | | | |
|---|---|---|---|---|
| 1,080,113 A | * | 12/1913 | Kügelgen et al. | 205/367 |
| 4,374,050 A | | 2/1983 | Ray | |
| 4,374,761 A | | 2/1983 | Ray | |
| 4,399,008 A | | 8/1983 | Ray | |
| 4,455,211 A | | 6/1984 | Ray et al. | |
| 4,582,585 A | | 4/1986 | Ray | |
| 4,584,172 A | | 4/1986 | Ray et al. | |
| 4,620,905 A | | 11/1986 | Tarcy et al. | |
| 4,713,152 A | * | 12/1987 | Walsh | 205/765 |
| 5,279,715 A | | 1/1994 | La Camera et al. | |
| 5,794,112 A | | 8/1998 | Ray et al. | |
| 5,865,980 A | | 2/1999 | Ray et al. | |
| 6,126,799 A | | 10/2000 | Ray et al. | |

FOREIGN PATENT DOCUMENTS

| | | | |
|---|---|---|---|
| EP | 0 255 411 | 2/1988 | F27D/17/00 |
| SU | XP-002224734 | 10/1976 | C25C/3/06 |

OTHER PUBLICATIONS

Reinhardt Schuhmann, Jr, Metallurgical Engineering, Engineering Principles, pp. 129–131, vol. 1, Addison–Wesley Publishing Company, Inc., Reading, Massachusetts (no date).

* cited by examiner

*Primary Examiner*—Donald R. Valentine
(74) *Attorney, Agent, or Firm*—Daniel P. Cillo; Glenn E. Klepac

(57) ABSTRACT

The present invention is directed to methods for preheating a molten salt electrolysis cell having inert anodes (24) using recuperative gas heating by combusting a first gas outside the cell chamber (20) in a combustion chamber (2) and using to heat a second gas in recuperator (8) which second gas us passed to the cell chamber (20). The inert anode can be a cermet inert anode.

22 Claims, 1 Drawing Sheet

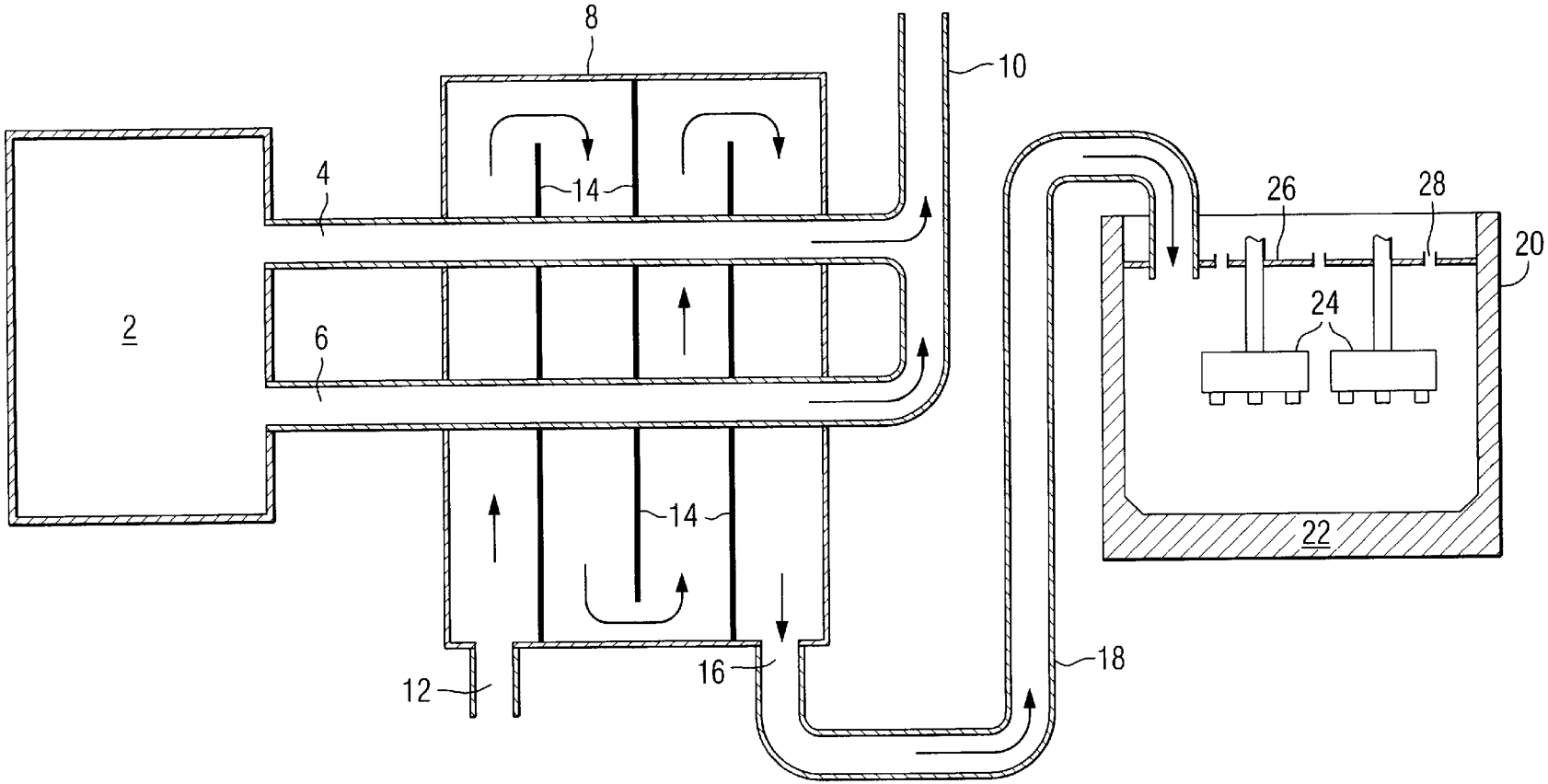
20
28
24
22
26
18
10
16
14
8
14
12
4
6
2

USE OF RECUPERATIVE HEATING FOR START-UP OF ELECTROLYTIC CELLS WITH INERT ANODES

FIELD OF THE INVENTION

The present invention relates to methods for start up of pots or cells used in the electrolytic production of metals. More specifically, the present invention relates to methods for preheating molten salt electrolysis cells so as to protect electrodes, especially inert anodes and their support structure assemblies, from thermal shock and exposure to products of combustion.

BACKGROUND OF THE INVENTION

Aluminum is produced conventionally by the electrolysis of alumina dissolved in cryolite-based molten electrolytes at temperatures between about 900° C. and 1000° C.; the process is known as the Hall-Heroult process. A Hall-Heroult reduction cell typically comprises a steel shell having an insulating lining of refractory material, which in turn has a lining of carbon that contacts the molten constituents. Conductor bars connected to the negative pole of a direct current source are embedded in the carbon cathode substrate that forms the cell bottom floor. The carbon lining and cathode substrate have a useful life of three to eight years, or even less under adverse conditions. The deterioration of the cathode bottom is due to erosion and penetration of electrolyte and liquid aluminum as well as intercalation of sodium, which causes swelling and deformation of the cathode carbon blocks and ramming mix. In addition, the penetration of sodium species and other ingredients of cryolite or air leads to the formation of toxic compounds including cyanides. Anodes are at least partially submerged in the bath.

In operation, the conventional cell contains an electrolytic, molten cryolite-based bath in which alumina is dissolved. A molten aluminum pool acts as the cathode. A crust of frozen electrolyte and alumina forms on top of the bath and around the anode blocks. As electric current passes through the bath between the anode and cathode surfaces, alumina is reduced to aluminum, which is deposited in the pad of molten metal.

Electrolytic reduction cells must be heated from room temperature to approximately the desired operating temperature before the production of metal can be initiated. Heating should be done gradually and evenly to avoid thermal shock, which can in turn cause breakage or spalling of the anodes, sidewalls and cathode blocks. The heating operation minimizes thermal shock to the lining and the electrodes upon introduction of the molten electrolyte to the cell. Thermal gradients as low as 50° C. can cause cracking.

Preheating of cells is typically performed by either a gas preheat or by resistor block. The gas pre-heating step results in the generation of products of combustion (POC), such as CO, $CO_2$, and $H_2O$, which can be deleterious to the inert anodes. CO can reduce the oxides in the anodes, eventually leading to corrosion. $CO_2$ and $H_2O$ can oxidize metallic constituents of the anode, again leading to corrosion. It is therefore desirable to protect the anodes from all constituents present in POC.

Aluminum electrolysis cells have historically employed carbon anodes on a commercial scale. The energy and cost efficiency of aluminum smelting can be significantly reduced with the use of inert, non-consumable, and dimensionally stable anodes. Use of inert anodes rather than traditional carbon anodes allows a highly productive cell design to be utilized, thereby reducing capital costs. Significant environmental benefits are also realized because inert anodes produce essentially no $CO_2$ or $CF_4$ emissions. Some examples of inert anode compositions are provided in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799, assigned to Alcoa Inc. These patents are incorporated herein by reference. Inert anodes can undergo thermal shock if heated or cooled too quickly, and should also be protected from exposure to POC.

SUMMARY OF THE INVENTION

The present invention is directed to methods for protecting electrodes, especially inert anodes, during start up of electrolytic cells, or "pots" as they are referred to in the art. Inert anodes should be carefully heated to temperature, and the gas atmosphere during heating around the anodes should be carefully controlled. More specifically, the gas atmosphere during heating should be maintained in a slightly oxidizing state, with enough oxidation to minimize carbon deposit or soot, but with not so much oxidation that exposed carbon in the cathode and/or sidewalls will be attacked. Inert anodes are protected both from thermal shock and from products of combustion (POC) according to the present methods.

The present invention is directed to the use of recuperative heating to pre-heat an electrolytic cell. Significantly, according to the present method exposure of the inert anodes to POC is eliminated. The gradual temperature increases to which the inert anodes, and other cell components, are exposed reduces, if not eliminates, thermal gradients that can cause spalling or breakage of the anodes.

BRIEF DESCRIPTION OF THE DRAWINGS

The FIGURE is a partially schematic sectional view of a gas recuperation system used for preheating an electrolysis cell according to one embodiment of the present invention.

DETAILED DESCRIPTION OF PREFERRED EMBODIMENTS

The present invention is directed to a method for preheating by recuperative heating a molten salt electrolysis cell having a chamber and an inert anode generally comprising the steps of combusting a first gas outside of the cell chamber, where the combusting produces heated products of combustion; passing the heated POC of the first gas through a gas recuperator; heating a second gas in the gas recuperator; and transferring the heated second gas to the cell chamber.

A first gas is combusted outside of the cell and passed through a gas recuperator. Any suitable gas that will give off heat when combusted can be used in the first step of the methods. Examples include natural gas, methane, ethane, propane, hydrogen and the like; a preferred gas is natural gas. The hot gas is passed through tubes into the gas recuperator; during this passage, the heated POC of the first gas heats the fire brick or other material of the gas recuperator.

The gas recuperator can be any recuperator system in which heat from one gas can be transferred to another gas. In a preferred embodiment, the gas recuperator is made of fire brick. The heat that results from combustion of the first gas is transferred to the fire brick or other material of the gas recuperator, which in turn transfers the heat to the second gas. A second gas is passed through cross flow channels in the gas recuperator to capture the heat emanating from the fire brick and the tubes through which the POC of the first heated gas are passing. In this manner, the second gas is heated. Such recuperators are well known heat exchangers and taught for example in *Metallurgical Engineering, "Combustion of Fuels and Heat Utilization",* Schuhmann, pp. 129–131 (1952). The heated non-combusted second gas is then introduced to the electrolytic cell that contains one or more inert anodes. This gas, which does not contain POC, in turn heats the inert anodes, and other cell components. The second gas can be any gas that would be suitable for introduction to the electrolytic cell, that is, any gas that would not have a deleterious effect on any of the cell components. A number of different gases can be used alone or in combination as the second gas, including but not limited to air, nitrogen, argon, any inert gas, any gas with controlled oxygen partial pressure such as $CO_2/CO$ gas mixtures, $H_2O/H_2$ gas mixtures or $N_2/O_2$ gas mixtures. If air is used as the second gas, then preferably those cell components that contain carbon will be protected from oxidation by application of an appropriate refractory protective layer. When coating the carbonaceous cell components, the use of refractory materials that are wetted by aluminum allows aluminum to be electrolytically deposited directly on a refractory material-coated cathode surface, and should avoid the necessity for a deep aluminum pool. Application of the protective layer can be by any means known in the art, such as by dipping or immersing the cell components in the protective material, spraying or painting the components with the protective material, or pouring the protective material onto the components. Other means of application include thermal spraying, electrocoating, electroless plating, physical vapor deposition, powder cementation, chemical vapor deposition, immersion, painting, and electrostatic spraying. A drying step can be employed following application of the protective layer.

Cells preheated according to the present invention can contain any type of inert anode, for example, those described in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799. "Inert anode" as used herein refers to a substantially nonconsumable anode that possesses satisfactory corrosion resistance and stability during the aluminum production process. Preferably, the inert anode is a cermet inert anode. "Cermet" refers to an inert anode comprising at least a ceramic phase and a metal phase. A separate protective layer can also be applied to the inert anodes to protect them from any trace gases present in the heated second gas.

Inert anodes of the present invention may be made entirely of a cermet material or can be a cermet material over a central metal core. When the cermet is provided as an outer coating its thickness is preferably about 0.1 to 50 mm, more preferably about 1 to 10 or 20 mm. The ceramic phase preferably makes up about 50–95 wt % of the cermet material, the metal phase about 5–50 wt %. More preferably, the ceramic phase comprises about 80–90 wt % of the cermet and the metal phase about 10–20 wt %.

In one embodiment of the present invention, the electrolytic cell contains cermet inert anodes in which the ceramic phase can be composed of any suitable oxide material including one or more metal oxides selected from the group consisting of Ni, Fe, Zn, Co, Al, Cu, Ti, V, Cr, Zr, Nb, Ta, W, Mb, Hf, and any of the rare earth metal oxides. A particularly preferred ceramic phase embodiment comprises iron, nickel, and zinc oxides. In this embodiment, the metal phase of the cermet material can comprise a base metal, such as Cu and/or Ag replaced in whole or in part by, or mixed or alloyed with, one or more metals selected from the group consisting of Co, Ni, Fe, Al, Sn, Nb, Ta, Cr, Mo, W, and the like. The metal phase may also comprise a noble metal such as one or more metals selected from Ag, Pd, Pt, Au, Rh, Ru, Ir, and Os. A preferred metal phase comprises copper as the base metal with the addition of at least one noble metal selected from Ag, Pd, Pt, Au, and Rh.

The metal phase may be continuous or discontinuous. When the metal phase is continuous it forms an interconnected network or skeleton that increases electrical conductivity. When the metal phase is discontinuous, discrete particles of the metal are at least partially surrounded by the ceramic phase, which may increase corrosion resistance. The types and amounts of base metal and noble metal contained in the metal phase are selected in order to reduce unwanted corrosion, dissolution, or reaction of the inert anodes, and to withstand the high temperatures to which the inert anodes are subjected during the electrolytic production process. For example, in the electrolytic production of aluminum, the production cell typically operates at a sustained smelting temperature above 800° C., usually about 900–980° C. Accordingly, the metal phase of inert anodes in such cells should have a melting point above 800° C., more preferably above 900° C., and optimally above about 1000° C.

It will be appreciated that during the present methods the entire cell and its components will be heated, not just the inert anodes. The term "cell components" refers collectively to inert anodes, the mechanical and electrical connectors and assemblies to which the anodes are attached, insulating lids, insulating linings, cell sidewalls, the cell bottom, cathode surfaces, cathode blocks and the like. It will be appreciated that many of the cell components are carbon-containing.

The present methods can be used in the preheating of electrolytic cells used in the production of a metal by electrolytic reduction of a metal compound contained in a molten salt bath. Metals that can be produced electrolytically in accordance with the invention include aluminum, lead, magnesium, zinc, zirconium and titanium. The methods are preferably applied to aluminum production.

FIG. 1 illustrates an embodiment of the present gas recuperative heating methods. A first gas is combusted in a combustion chamber 2 outside of the electrolysis cell chamber 20. POC of the heated first gas are transferred to gas recuperator 8 by channels 4 and 6 extending from combustion chamber 2 through gas recuperator 8 and out through conduit 10 to the atmosphere. While heated first gas is passing through gas recuperator 8, a second gas is introduced to gas recuperator 8 through inlet 12. The second gas passes through gas recuperator 8 around baffle plates 14 as illustrated by the arrows in the FIGURE; the second gas is heated during the process without contacting the POC of the first gas. Heated second gas passes out of the gas recuperator 8 at outlet 16, and is transferred to an electrolytic cell chamber 20 by conduit 18. The electrolytic cell comprises, among other things, cathode 22 and inert anodes 24. An insulated cover 26 keeps the heated second gas in contact with cathode 22 and anodes 24. After heating, the second gas is released to the atmosphere through vents or holes 28 in the cover. Flow of the second gas can be restricted on some instances for a period of time effective to heat the electrolysis cell components, such as by closing or partially closing some of the exit vents 28.

Thus, the present invention provides a method for preheating an electrolytic cell comprising various cell components including one or more inert anodes. According to these methods, electrolytic cells and their components can be heated gradually to minimize if not avoid thermal shock and the breaking and/or spalling that it can cause. Heating can be effected at any rate desired by the user. A rate of between about 15° C. and 45° C. per hour is typical, with a rate of between about 25° C. and 30° C. per hour being preferred.

The present invention offers significant advantages in the preheating of electrolytic cells. Inert anodes can be heated in the cell, thereby eliminating the need to transfer hot anodes from a separate preheat furnace to the cell. The present methods also eliminate exposure of the inert anodes and other cell components to POC during start-up.

Whereas particular embodiments of this invention have been described above for purposes of illustration, it will be evident to those skilled in the art that numerous variations of the details of the present invention may be made without departing from the invention as defined in the appended claims.

Having described the presently preferred embodiments, it is to be understood that the invention may be otherwise embodied within the scope of the appended claims.

What is claimed is:

1. A method for preheating by recuperative gas heating a molten salt electrolysis cell having a chamber and an inert anode, comprising:

(a) combusting a first gas outside of the cell chamber, said combusting producing heated products of combustion;

b) passing the heated products of combustion of said first gas through a gas recuperator comprised of fire brick;

c) heating a second gas in the gas recuperator without contacting the products of combustion of the first gas; and d) transferring the heated second gas to the cell chamber.

2. The method of claim 1, wherein said first gas is selected from the group consisting of methane, ethane, propane, hydrogen and natural gas.

3. The method of claim 2, wherein said first gas is natural gas.

4. The method of claim 1, wherein said second gas is an inert gas.

5. The method of claim 4, wherein said second gas is air, nitrogen, or argon.

6. The method of claim 1, wherein said second gas is selected from the group consisting of $CO_2/CO$, $H_2O/H_2$ and $N_2/O_2$ gas mixtures.

7. The method of claim 1, wherein said first gas is natural gas and said second gas is nitrogen.

8. The method of claim 1, wherein said inert anode is a cermet inert anode.

9. The method of claim 1, further comprising the step of e) restricting the passage of said second gas from said cell for a period of time sufficient to heat the cell components.

10. The method of claim 1, wherein heating of said cell is effected at a rate between about 15° C. and 45° C. per hour.

11. The method of claim 10, wherein heating of said cell is effected at a rate between about 25° C. and 30° C. per hour.

12. The method of claim 10, wherein said second gas is air.

13. The method of claim 1, further comprising the step of applying a protective layer to carbon-containing cell components of the cell prior to step d).

14. The method of claim 13, further comprising the step of applying a protective layer to the inert anode prior to step d).

15. A method for preheating by recuperative gas heating an electrolysis cell including a cell chamber, a molten salt bath, and an inert anode, comprising a) combusting a first gas outside the cell chamber, said combusting producing heated products of combustion, b) passing said heated products of combustion through a gas recuperator, c) heating a second gas in die gas recuperator so that said second gas does not contact said heated products of combustion, d) transferring the heated second gas to the cell chamber, and e) restricting passage of said second gas from said cell for a period of time sufficient to heat the cell components.

16. The method of claim 15, wherein said second gas is selected from the group consisting of $CO_2/CO$, $H_2O/H_2$, and $N_2/O_2$ gas mixtures.

17. The method of claim 15, wherein step (e) comprises heating components of lie cell gradually to avoid thermal shock.

18. A method for preheating by recuperative gas heating an electrolysis cell for alumina production having carbon-containing cell components and a cell chamber and an inert anode, comprising a) applying a protective layer to said carbon-containing cell components, b) combusting a first gas outside the cell chamber, said combusting producing heated products of combustion, c) passing said heated products of combustion through a gas recuperator, d) heating a second gas in the gas recuperator without contacting said heated products of combustion, and e) transferring the heated second gas to the cell chamber.

19. The method of claim 18, wherein said second gas is selected from the group consisting of $CO_2/CO$, $H_2O/H_2$, and $N_2/O_2$ gas mixtures.

20. The method of claim 19, wherein said gas recuperator is comprised of fire brick.

21. The method of claim 18, further comprising the step of applying a layer to said inert anode prior to step (d).

22. The method of claim 18, wherein step (d) comprises heating components of the cell gradually to avoid thermal shock.

* * * * *

UNITED STATES PATENT AND TRADEMARK OFFICE

CERTIFICATE OF CORRECTION

PATENT NO. : 6,607,656 B2
DATED : August 19, 2003
INVENTOR(S) : Roy A. Christini It is certified that error appears in the above-identified patent and that said Letters Patent is hereby corrected as shown below:

Column 6,
Line 30, delete “lie” and substitute therefor -- the --.
Line 51, after “applying a” insert -- protective --.

Signed and Sealed this

Ninth Day of November, 2004

JON W. DUDAS
*Director of the United States Patent and Trademark Office*